US005582564A

United States Patent [19]

Nichols, Sr. et al.

[11] Patent Number: 5,582,564

[45] Date of Patent: Dec. 10, 1996

[54] UPPER TORSO EXERCISE METHOD

[75] Inventors: Raymond L. Nichols, Sr.; Raymond L. Nichols, II, both of Cleveland, Tenn.

[73] Assignee: Southern Xercise, Inc., Cleveland, Tenn.

[21] Appl. No.: 192,446

[22] Filed: Feb. 7, 1994

[51] Int. Cl.[6] ..... A63B 21/078

[52] U.S. Cl. ..... 482/97; 482/98; 482/134; 482/137

[58] Field of Search ..... 482/72, 73, 92–94, 482/97, 98, 104, 133, 135–139, 134, 142, 100, 101; 601/33; 434/254

[56] References Cited

U.S. PATENT DOCUMENTS

| | | | |
|---|---|---|---|
| 4,407,503 | 10/1983 | Nishizawa | 273/195 A |
| 4,563,000 | 1/1986 | Gall | 482/72 |
| 4,666,149 | 5/1987 | Olschansky et al. . | |
| 4,750,736 | 6/1988 | Watterson | 482/73 |
| 4,872,670 | 10/1989 | Nichols . | |
| 5,108,095 | 4/1992 | Nichols . | |
| 5,116,297 | 5/1992 | Stonecipher | 482/137 |
| 5,336,148 | 8/1994 | Ish, III | 482/139 |
| 5,437,589 | 8/1995 | Habing | 482/136 |
| 5,462,507 | 10/1995 | Nichols, Sr. et al. | 482/104 |

FOREIGN PATENT DOCUMENTS

| | | | |
|---|---|---|---|
| 177017A | of 1986 | European Pat. Off. . | |
| 3409246 | 2/1986 | Germany | 482/137 |

OTHER PUBLICATIONS

Schwarzenegger, Arnold, *Encyclopedia of Modern Bodybuilding*, with Dobbins, Bill, Simon and Schuster, Inc., N.Y., N.Y., 1987, p. 298.

*Primary Examiner*—Richard J. Apley
*Assistant Examiner*—Victor K. Hwang
*Attorney, Agent, or Firm*—Paul E. Hodges, P.C.

[57] ABSTRACT

Apparatus for the exercise of a person's upper torso wherein there is minimal unnatural motion or positioning of the glenohumeral joint and/or the wrist and elbow joints and including means for carrying each of the person's arms through movement generally within a transverse plane that is occupied by the wrist, elbow and shoulder joints, this means comprising at least one set of outrigger arms arranged for pantographic motion about fixed axes which are substantially coincident with the median sagittal plane of the person's body. A method for the upper torso exercise is disclosed.

8 Claims, 9 Drawing Sheets

UPPER TORSO EXERCISE METHOD

FIELD OF INVENTION

This invention relates to a method for the exercise of the upper torso muscles of a human being. The disclosed method provides for directed deployment of essentially only the upper torso muscles to the substantial exclusion of the muscles of the lower body, thereby making the invention useful for exercise of persons of limited lower body muscular activity.

BACKGROUND OF THE INVENTION

Exercising of the upper torso necessarily involves movements of the upper limbs which in turn involves the upper torso muscles and, importantly, the wrist, elbow and shoulder joints.

The upper torso muscles include the larger muscle groups such as the pectoralis major and minor, deltoids, latissimus dorsi, triceps, biceps, trapezius, teres major and several smaller muscle groups such as the infraspinatus, supraspinatus, splenius capitis, rhomboideus minor and major, levator scapulae, etc. Exercise of the upper torso muscles most commonly involves extensive use of the upper limbs, inasmuch as each of the larger muscle groups is directly or indirectly connected at one of their respective ends to the upper end of the humerus or an element of the glenohumeral joint (shoulder joint) in general.

The shoulder joint includes, among other elements, the head of the humerus which is a typical ball, and which is cradled in the glenoid fossa of the scapula. The glenoid fossa is shallow and more flat than concave, such that it presents a much smaller articular surface than the head of the humerus. The fossa is widened and slightly deepened by a rim of fibrocartilage, known as the glenoidal labrum, so that the construction of the shoulder ball and socket joint favors a wide range of movement of the arm relative to the body proper, but at the expense of union and stability. The encapsulation of the humerus head is lax so that there can be extensive and free movement of the arm. Neither the configuration of the articulating surfaces nor the disposition of the articular capsule furthers stability. The articular capsule, however, does include other elements which tend to stabilize the glenohumeral joint. These include various ligaments which fully or partially span the joint. The greatest stability for the glenohumeral joint is provided by the muscle groups which cross the joint and produce some of its movements. Four muscles approach the joint from the scapula. The subscapularis muscle passes in front of the joint. The supraspinatus crosses the joint superiorly. The infraspinatus muscle extends behind the joint. The teres minor muscle similarly is located posterior to the joint. These muscles and their tendons form a partly muscular, partly tendinous hood or cuff about the capsule that invests its anterior, superior, and posterior surfaces. The close investment of the capsule by these muscles and tendons has led to their designation as the musculotendinous cuff of the shoulder joint. These muscles hold the humerus to the glenoid fossa, strengthen the capsule, and flexibly resist undue movements of the humeral head in anterior, superior, and posterior direction. Since all these muscles produce rotations of the humerus, the functional structure is also referred to as the rotator cuff. Other muscles contribute lesser degrees of stability to the joint.

The movements of the shoulder joint, which are increased by associated movement of the scapula, are movements of the upper torso. The major movements occurring at the shoulder joint include:

1. Flexion in which the humerus is brought forward beside the thorax. Continued flexion carries the humerus upward as well as forward and, finally, upward and backward beside the head to a vertical position.
2. Extension in which the humerus is returned from any position of flexion to the anatomic position or is carried backward from the position beside the thorax.
3. Abduction in which the humerus moves laterally away from the body. Continued abduction carries the humerus upward as well as laterally and, finally, upward and medially to a vertical position beside the head.
4. Adduction in which the humerus is returned to the side of the body from any degree of abduction. The thorax prevents further movement toward the midline of the body, but if adduction is combined with partial flexion the arms can be carried across the front of the chest and crossed. Since the glenoid fossa faces forward as well as laterally, a similar combination of adduction and extension is less free, but the same effect can be obtained by bending of the elbows as in clapping of the hands behind the back.
5. Rotations in which the anterior aspect of the humerus turns medially (medial and internal rotation) or laterally (lateral or external rotation). Rotations combine with other movements. For example, medial rotation occurs with and facilitates full flexion to the vertical position, and lateral rotation occurs increasingly with abduction to the vertical position.
6. Combined movements in which several movements occur simultaneously or progressively are the basis of most natural motions at the shoulder joint. Circumduction, as a joint movement in general, is defined in terms of the shoulder joint. Lateral rotation of the scapula turns the glenoid fossa upward to make possible full abduction of the shoulder joint. Otherwise the humerus would impinge upon the acromion to stop the movement. Retraction of the scapula carries the glenoid fossa backward and turns it more laterally to facilitate extension of the shoulder joint. Protraction of the scapula occurs with shoulder flexion to turn the glenoid fossa forward.

In view of the structure of the glenohumeral joint, in the exercise of the upper torso, it is of paramount importance that the exercise not irritate, nor exacerbate an existing irritation or weakness in the shoulder joint. In like manner, the exercise should not cause the shoulder joint to be subjected to unnatural movements. In this respect, it is particularly important that the shoulder joint not be exposed to undue stress or strain at or near the natural limits of the range of motion of the joint.

In the prior art, it has been proposed and practiced that exercise of the muscles of the upper torso may be accomplished employing mechanical exercise devices such as the barbell, hand barbells, flye machines, various vertical lifting or pull-down devices, and the like. For example, in the barbell snatch exercise, the person grasps the barbell with their hands at spaced apart locations on the bar, and then proceeds to "snatch" the barbell from the floor and lift it above the head. The hands remain in firm gripping relationship to the bar during the exercise, thereby requiring the shoulder joint (and the elbow and wrist joints) to rotate. Due to the spaced-apart locations of the hands, these rotational movements are unnatural and great strain is placed upon the shoulder, elbow and wrist joints.

Bench pressing is another of the prior art techniques employed in exercising of the upper torso muscles. Again, in bench pressing, the hands of the person are "fixed" at spaced apart locations on the barbell, so that as the arms are moved through their paths of movement as the barbell is lifted and lowered, there occurs unnatural rotational movement of the upper limb joints. A vast majority of the persons performing the bench press (whether using a barbell or one of the more recent push-pull mechanical exercise devices) begin the press at a position in which the barbell is touching the chest. In this position, this majority of persons has a rib cage thickness-arm length ratio that requires excessive motion at the shoulder joint to touch the bar to the chest. In this position of the barbell, the mechanical advantage for the pectoralis major is dramatically decreased due to a decrease, or even non-existent force angle of the muscle. In fact, throughout a majority of the motion occasioned by this exercise, the bar is lowered by the pectoralis major to a position where it has little or no mechanical ability, and consequently, the shoulder joint strength range is violated.

Chest press machines, like a barbell, require a fixed hand placement that does not allow for the complete motion of horizontal adduction. Also, the arc of motion made by the machine may actually take away from the movement of the pectoralis muscles.

Exercises performed with individually hand-held dumbbells can eliminate unnatural rotation, or lack of proper rotation, of the upper limb joints. Dumbbell presses or flyes allow full horizontal adduction, but at the top of the movement, or at a fully adducted position, there is no resistance against the pectoralis, for example. With free weights such as dumbbells, there is maximum resistance at the point in full horizontal abduction where the pectoralis muscle is mechanically less effective. The exercise further encourages motion beyond anatomical and mechanical limits. So-called "pec decks" and flyes present further problems in that the axes of these machines are either too narrow or too far anterior to the glenohumeral joint and tend to pull the user into unwanted protraction. Also, with these machines, the shoulder is positioned at 90 degrees of external rotation and 90 degrees of abduction. This is an extremely compromising position for the glenohumeral joint, especially when moving posterior to the frontal body plane.

SUMMARY OF THE INVENTION

In accordance with the present invention, there is provided means for the exercise of the upper torso wherein there is minimal unnatural motion or positioning of the glenohumeral joint and/or the wrist and elbow joints. In particular, there is no material abnormal rotation of the glenohumeral (shoulder) joint over the entire range of motion of the exercise, while simultaneously providing full range of motion of the muscles that are involved in the exercise. Further the present invention provides controlled resistance to movements of the elements of the upper torso over a maximum portion of their respective ranges of movement, thereby effectively eliminating the prior art problems associated with inordinate exertion of the upper torso muscles at or near their points of minimum and maximum range of motion. These and other advantages of the present invention are accomplished through means which carries each of the user's arms through a range of motion that essentially follows both the normal range of motion of each such arm and importantly, this movement is restricted to movement generally within a transverse plane that is occupied by the wrist, elbow and shoulder joints. Simultaneously and within this transverse plane, there is provided a controlled resistance to the motion of each arm over essentially the entire normal range of motion of the arm.

In a preferred embodiment of the present invention, there is provided at least one movable resistance unit which comprises an outrigger set of arms that are arranged for pantographic motion about a fixed axis which is substantially coincident with the median sagittal plane of the user's body. Means provided on the outrigger set project inwardly toward the user's body in position to be grasped by the hand of the user for urging the outrigger set through its range of motion. By these means, the user's hand position relative to the user's body is selectable by the user to the most normal position for the hand for pushing and/or pulling. When the hand is so positioned, and force is exerted by the user to move the outrigger set, the hand is caused to follow a path which is determined by the motion of the outrigger set and which lies in a plane that is transverse to the body. This path, by reason of the pantographically-determined motion, is generally arcuate and resides in a single plane, as is the natural motion of the user's limb, as is desired, and permits the hand (and the limb) to follow the arcuate path and thereby allows the user to maintain a straight-line relationship between the hand, the wrist and the lower arm over essentially the entire range of movement of the outrigger set. In like manner, the natural arcuate motion of the hand within the transverse plane of movement of the limb as established by the paint motion of the outrigger set permits only natural motions of the glenohumeral joint. In accordance with one aspect of the invention, the resistance to movement offered by the outrigger set may be selected from very little to a very large amount of resistance through the selection of counterbalancing weights or added weight to the outrigger set.

In another aspect of the invention, the degree of resistance provided by the outrigger set may be adjusted to provide varying resistance to the movement of the outrigger set over the range of movement of the outrigger set, thereby providing, for example, minimal exertion of resistance at those points along the path of the outrigger set where the muscles of the user are at their least advantage to overcome the resistance. Conversely, at those points along the path of movement of the outrigger set where the user's muscles are capable of exerting their maximum energy to overcome resistance to movement, the resistance to such movement offered by the outrigger set may be adjusted accordingly. Still further, by reason of the outrigger set having a fixed axis aligned with the midline of the user's body, inordinate adduction and/or abduction of the user's upper limb or limbs is precluded.

In the preferred embodiment wherein two outrigger sets are provided, one outrigger set being located on each side of the user's body in position for grasping one set with one hand and the other set with the other hand. In this embodiment, the two outrigger sets preferably employ a fixed axis of rotation that is essentially coincident with the median sagittal plane of the user's body. In one aspect of the invention, the fixed axis of rotation of the two outrigger sets is common to the sets.

The apparatus of the present invention is capable of use by a person in the supine position, standing position, or sitting position. To this end, means is provided for receiving the user in either of these selected positions.

It is therefore an object of the present invention to provide an improved method and apparatus for the exercise of the upper torso of a person.

It is another object of the present invention to provide for the exercise of the upper torso of a person employing ranges of motion of the user's upper torso which are within the normal ranges of movement of such upper torso.

It is another object of the present invention to provide apparatus for use in the exercise of a person's upper torso in which there is minimal stress or strain upon the wrist, elbow and shoulder joints of the user.

Other objects and advantages of the invention will be apparent from the description thereof contained herein, including the claims and the figures in which:

DETAILED DESCRIPTION OF INVENTION

Figure 1:
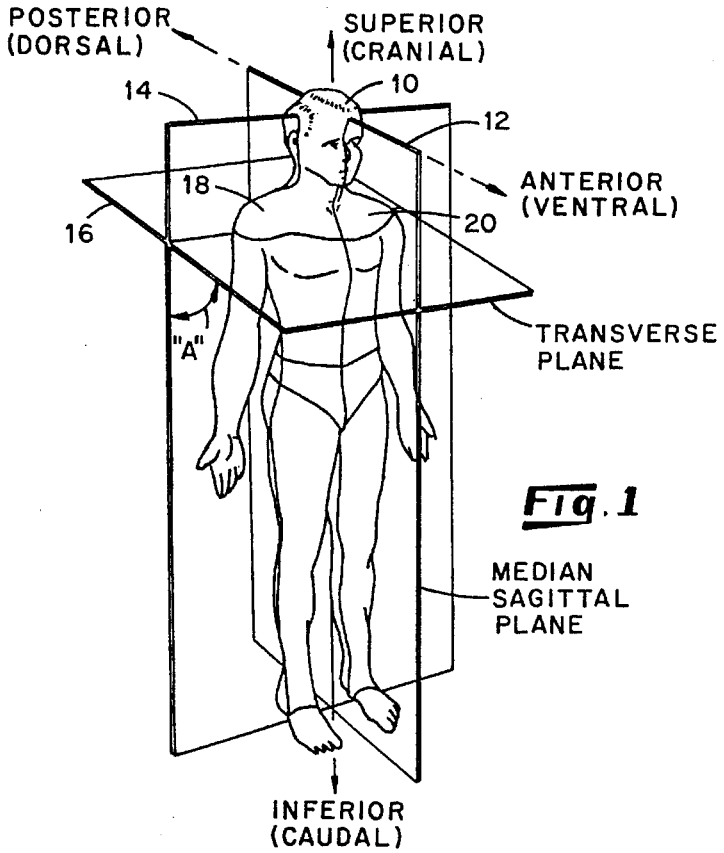
FIG. 1 is a diagrammatic representation of a human body and showing various anatomical references, including the transverse plane and the median sagittal plane.
Figure 2:
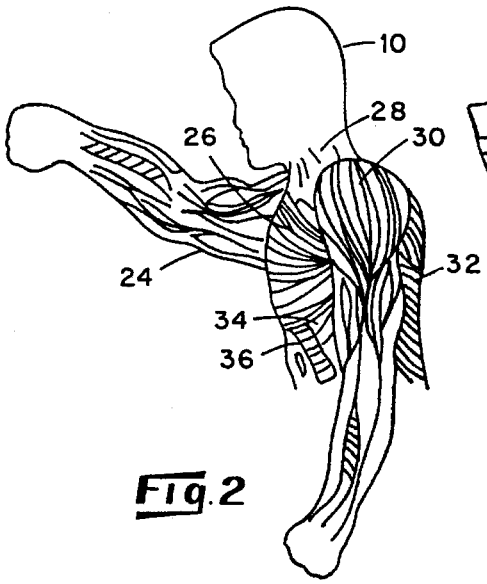
FIG. 2 is a diagrammatic representation of a portion of a human body and showing several of the muscle groups of the upper torso.
Figure 3:
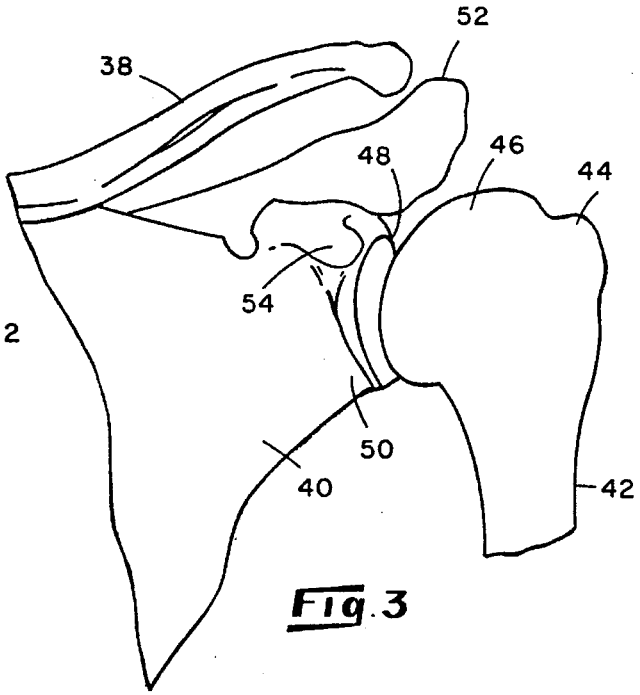
FIG. 3 is a diagrammatic representation of a shoulder joint and depicting various of the features thereof.

By way of further defining certain aspects of the human body, attention is invited to FIGS. 1, 2 and 3. In FIG. 1 there is depicted a human body 10 and the median sagittal plane 12, the frontal or coronal plane 14 and the transverse or horizontal plane 16 thereof. In FIG. 1, the transverse plane 16 is taken through the shoulder joints, indicated generally by the numerals 18 and 20, of the body inasmuch as the transverse plane referred to in the present invention is to be understood to be taken as including the shoulder joints as depicted in FIG. 1. The angle "A" which the transverse plane 16 assumes with respect to the coronal plane 12 may be varied in accordance with the present invention as will appear more fully hereinafter, between zero and 180 degrees.

In the human body 10 depicted in FIG. 2, there are depicted several of the major muscle groups of the upper torso of a human body, including the triceps 24, pectoralis 26, trapezius 28, deltoid 30, latissimus dorsi 32, serratus anterior 34 and obliques 36.

The bone structure of the shoulder joint of a human body is depicted in FIG. 3 for reference purposes and includes the clavicle 38, scapula 40, humerus 42, greater tuberosity 44 of humerus, head of humerus 46, glenoid fossa 48, glenoid neck 50, acromion process 52, and coracoid process 54. A review of FIGS. 1–3 provides a brief overview of the relative complexity of the construction of the upper torso and emphasizes the need for careful attention to the movement of the upper limbs when exercising the upper torso.

Figure 4:
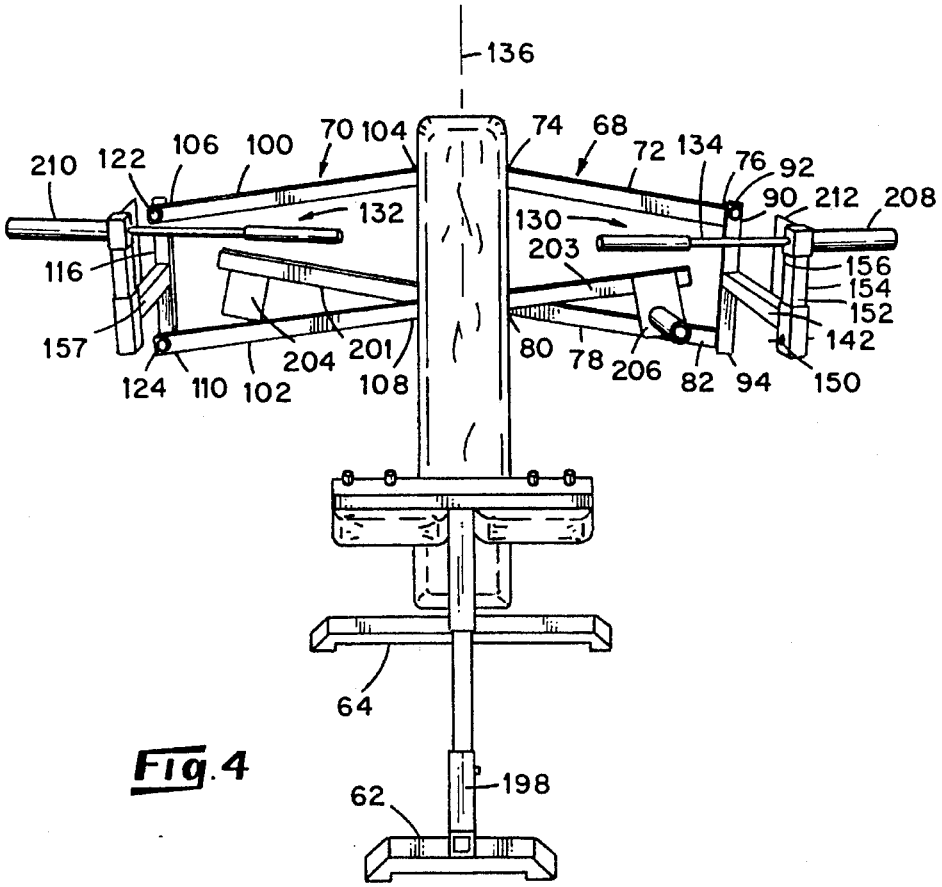
FIG. 4 is a frontal view of one embodiment of an apparatus embodying various of the features of the present invention including means for supporting a user in a sitting position and providing for abduction and adduction movements of the humerus.
Figure 5:
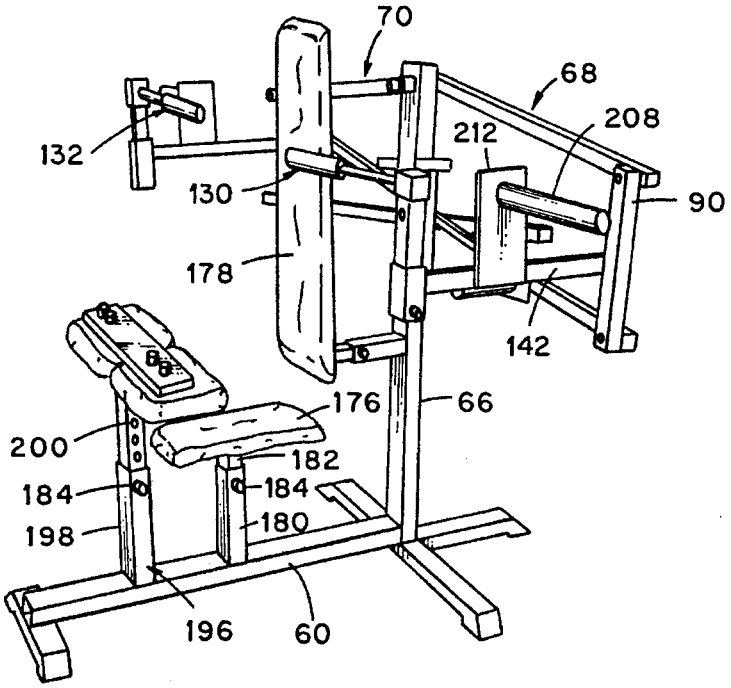
FIG. 5 is a representation, in perspective, of the right hand side of the apparatus depicted in FIG. 4.
Figure 6:
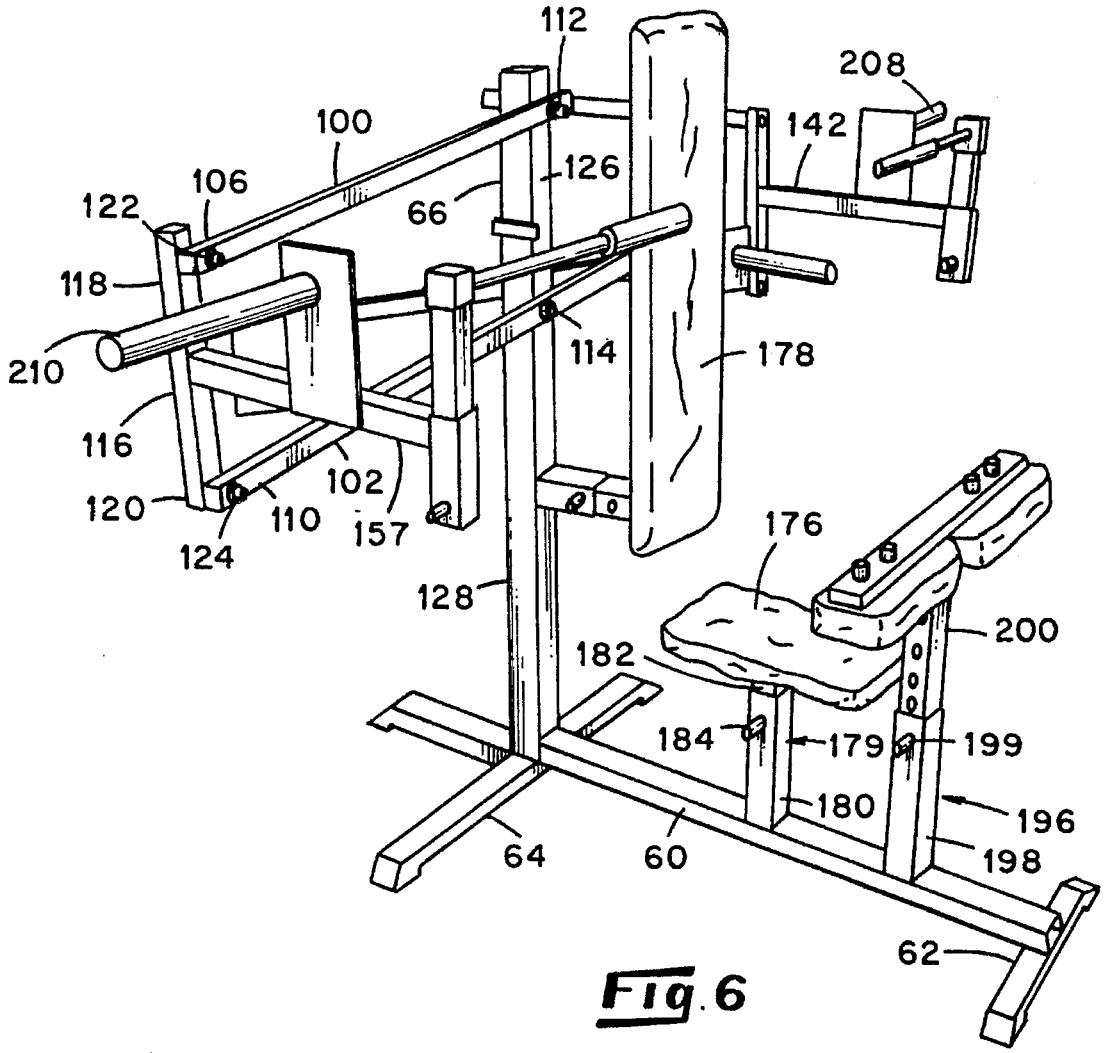
FIG. 6 is a representation, in perspective, of the left hand side of the apparatus depicted in FIG. 4.
Figure 7:
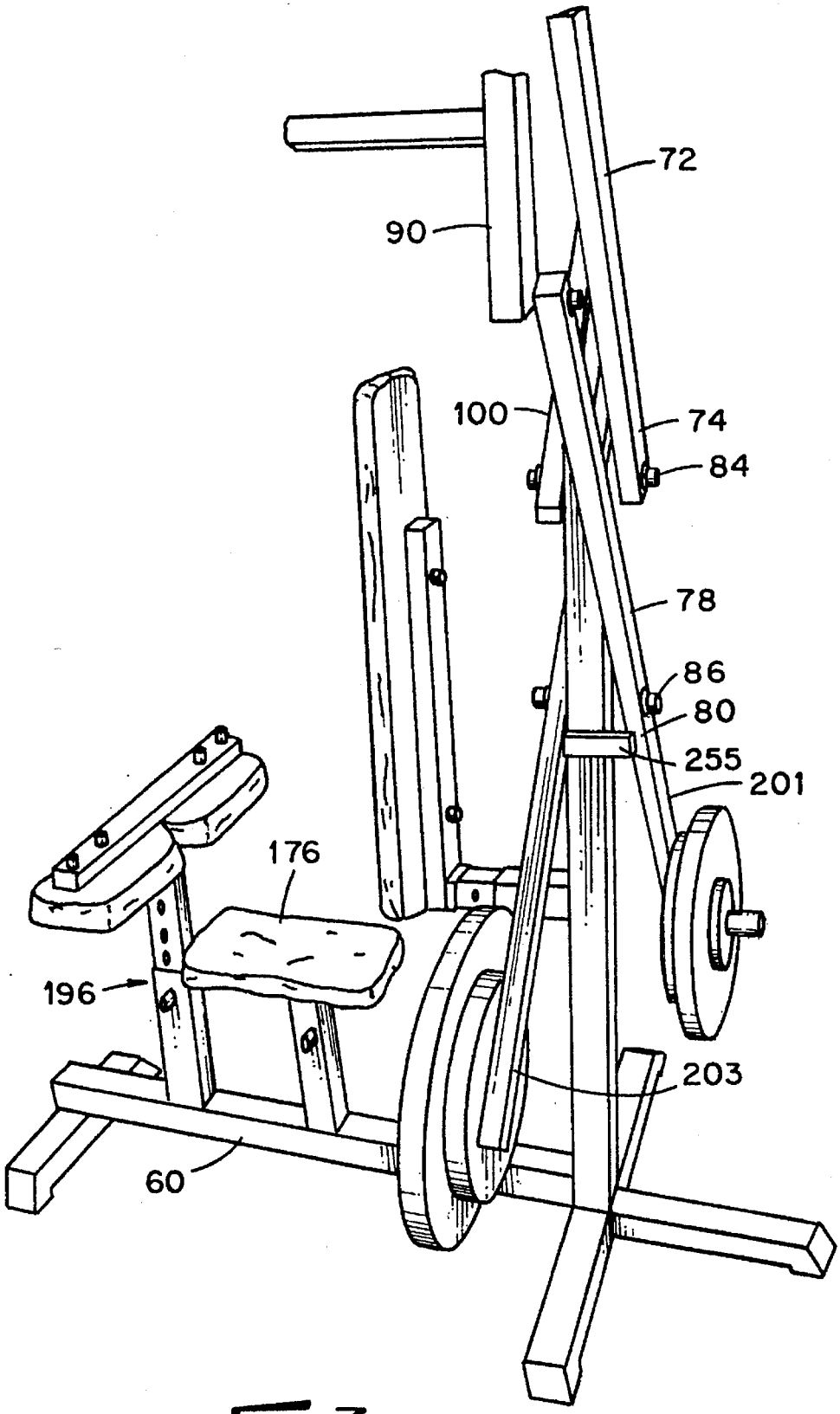
FIG. 7 is a view of the apparatus of FIG. 4 as viewed from the left side of the apparatus depicted in FIG. 4 and slightly from the rear of the apparatus.

FIGS. 4–8 depict one embodiment of apparatus employing various of the features of the present invention. As depicted, the apparatus includes a base member 60 adapted to rest on a supporting surface (not shown) and provide stable positioning of the apparatus on the supporting surface. To this end, the base member 60 includes cross members 62 and 64 which lend lateral stability to the apparatus. As best seen in FIGS. 5 and 6, a vertical upright 66 is secured to the base member and extends upwardly therefrom to receive thereon first and second sets of outrigger arms 68 and 70 (see FIG. 4). Each set of outrigger arms, set 68, for example, includes a first rigid elongated arm 72 having opposite ends 74 and 76 and a second rigid elongated arm 78 also having opposite ends 80 and 82. The ends 74 and 80 of each of the arms 72 and 78, respectively, are each pivotally mounted to the upright 66 at vertically spaced apart locations by means of pivot pins 84 and 86 which define fixed rotational axes for the ends 74 and 80 of the arms 72 and 78. In the embodiment depicted in FIGS. 5–8, these axes are horizontally oriented. The ends 76 and 82 of the arms 72 and 78, respectively are outboard of the pivotally-mounted opposite ends of the respective arms and are free for controlled movement, generally within a horizontal plane in FIGS. 4–8. These outboard ends 76 and 82 are joined one to the other by a rigid elongated bar 90 having one of its ends 92 pivotally connected to the outboard end 76 of the arm 72 and the other of its ends 94 pivotally connected to the outboard end 82 of the other of the arms 78 of the set, thereby defining a parallelogram which includes a portion of the vertical upright 66, the arms 72 and 78 and the bar 90.

In the depicted embodiment of FIGS. 4–8, the second set of outrigger arms 70 is substantially a mirror image of the first set 68, and includes first and second arms 100 and 102 having opposite ends 104, 106, 108 and 110, respectively. The inboard ends 104 and 108 of the arms 100 and 102 are pivotally mounted to the vertical upright 66 in like manner as the arms 72 and 78 of the first set, by pivot pins 112 and 114, or like pivotal connectors, which define horizontal rotational axes for the arms 100 and 102. The outboard ends 106 and 110 of the arms 100 and 102 are connected one to the other by means of a rigid bar 116 whose opposite ends 118 and 120 are each pivotally connected by pivot pins 122 and 124 to the outboard ends 106 and 110 of the arms 100 and 102 to define a second parallelogram which includes a portion of the vertical upright 66 between the pivot pins 112 and 114, the arms 100 and 102 and the connecting bar 116. In the preferred embodiment, the first and second set of outrigger arms occupy the same plane or parallel planes that are nearly the same, that is the planes are parallel but may be displaced from one another. Whereas the pivotal connections of the inboard ends of each of the arms of the sets of outrigger arms are depicted as being on opposite sides of the vertical upright 66, i.e. front and back sides 126 and 128, so that the sets of outrigger arms occupy slightly offset parallel planes, it is to be recognized that the pivotal connections of the inboard ends of the sets of outrigger arms may be common to the two sets, or may be located on the vertical upright such that the sets of outrigger arms occupy a common plane. Such offsetting of the planes occupied by the sets of outrigger arms is a matter of choice and does not adversely affect the desired operation of the apparatus, in that such offset can be adjusted for by means of selecting the location of other elements of the apparatus, such as the handhold means, as will appear more fully hereinafter.

In accordance with one aspect of the invention, there is secured to each of the rigid connecting bars 90 and 116 a handhold means indicated generally at 130 and 132, respectively, each of which may take the form of a rigid rod 134 that is mounted in cantilevered fashion to the connecting bar 90, and extends horizontally inwardly toward the vertical midplane 136 of the apparatus and in position to be grasped in the hand 138 of a person 140 which is using the apparatus for exercising their upper torso. The mounting of the handhold means 130 to the connecting bar 90 may take the form of a first horizontal bar 142 to which there is secured a vertically oriented hollow tubular mounting member 144. A series of spaced-apart, aligned openings through opposite ones of the walls 146 and 148 of the tubular member 144 are provided for receiving therethrough a positioning pin 150. A further tubular member 152 is slidably received within the tubular member 144, this further tubular member 152 also having a series of spaced-apart aligned openings through opposite ones of the walls 154 and 156 thereof such that when selected ones of the aligned openings through the walls of the first tubular member 144 are in register with selected ones of the aligned openings through the walls of the further tubular member 152, the positioning pin 150 may be passed through all the registered openings to thereby set the vertical position of the further tubular member 152 with respect to the first tubular member 144, and therefore with respect to the connecting bar 90. As desired, the handhold means may be provided with a padded portion 158. As noted, the second set of outrigger arms 70 is provided with a further handhold means 132 substantially identical to the handhold means 130 and adjustably mounted to the rigid bar 157, such further handhold means projecting in cantilevered fashion inwardly of the apparatus, such that the two handhold means are disposed one each on the opposite sides of the person using the apparatus, and in position to be grasped by the hands of a person "as thus disposed, the handhold member associated with each set of arms of each outrigger set, is laterally displaced from the median sagittal plane of the upper torso of the user and in a transverse plane of which defines an angle of between zero and 180 degrees with the coronal plane of the upper torso, and is movable within this transverse plane between first and second positions."

Figure 8:
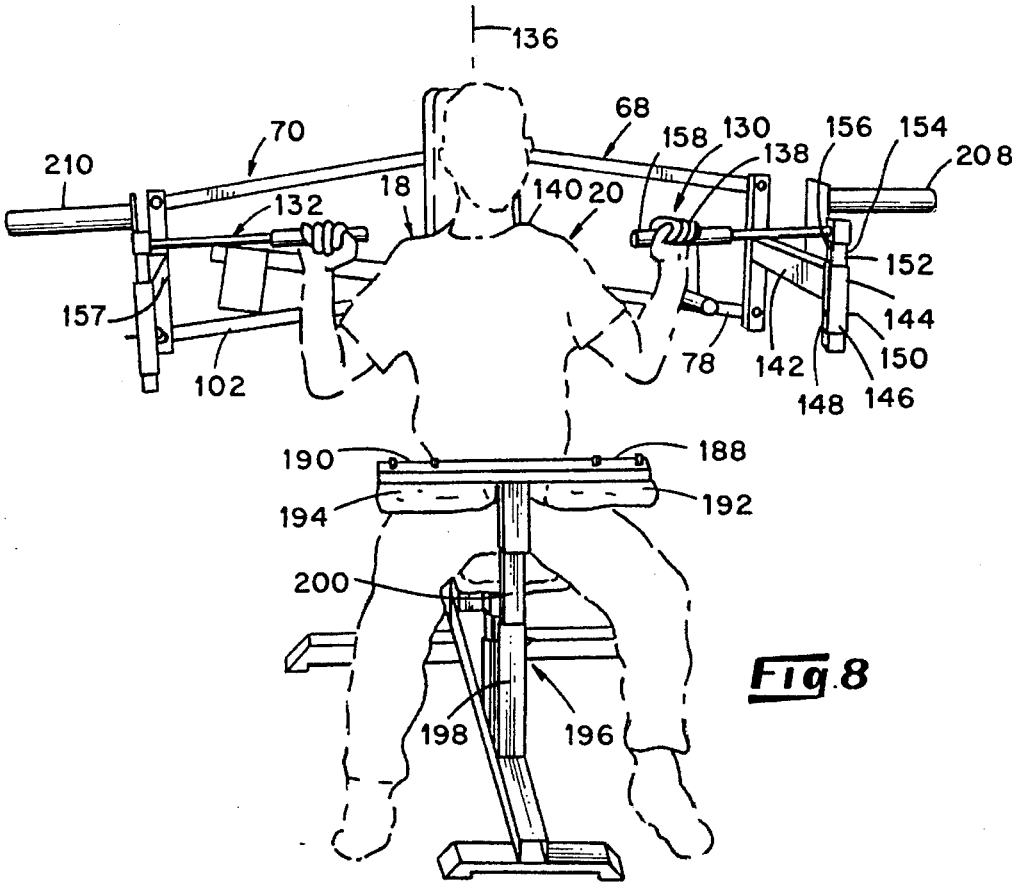
FIG. 8 is a front view of the apparatus of FIG. 4 and depicting a user in position for use of the apparatus for exercising the user's upper torso.

With specific reference to FIGS. 6 and 8, the depicted embodiment of the invention includes a horizontal bench 176 and a vertical back 178 adapted to support a person in a sitting position for use of the present apparatus. The bench 176 is mounted on the support 60 by means of a height-adjustable mounting 179 comprising a first vertical hollow tubular member 180 and a second tubular member 182 telescopically received within the first member. Appropriate through openings provided in the two members receive a positioning pin 184 when selected ones of the openings are in register at a selected vertical level for the bench. When the person is properly seated on the bench, their median sagittal midplane is vertical and aligned with the vertical midplane 136 of the apparatus and with their shoulder joints at substantially the same vertical height as the handhold members 130 and 132, one each of which is disposed on opposite sides of the person in position to be grasped by the person as depicted in FIG. 8. In this position, the elbow, wrist and hand of the person's arm are in vertical straight-line alignment.

As depicted in FIG. 8, in one embodiment of the present apparatus, the knees of the seated user are disposed beneath knee pads 188 and 190 which include horizontal padded members 192 and 194 that are mounted on a height-adjustable stand 196. This stand is substantially the same as the bench stand 179 and comprises first and second telescoping tubular members 198 and 200, the first of which is secured to the support 60 and extends vertically upwardly therefrom. The second member 200 is telescopically received within the first member and their combined height is adjustable by means of through openings in the members and a positioning pin 199 which is insertable through registered ones of the openings. These knee pads preclude upward movement of the knees of the user during the course of exercising using the apparatus.

Referring specifically to FIG. 4, whereas the arms 78 and 102 are indicated to terminate at their ends 80 and 82, and 108 and 110, respectively, in accordance with one aspect of the invention, each of the arms 78 and 102 is extended outboard of its respective pivotal attachment 86 and 114, respectively, to the upright 66. The outboard end of each such extension 201 and 203, is provided with a rigid receiver 204 and 206, respectively, for one or more free weights (not shown), for example. By this means, the free weights provide counterbalancing of the sets of outrigger arms 68 and 70. In the event the user desires added weight be applied to the sets of outrigger arms 68 and 70, each of the connecting bars 142 and 157 is provided with respective mounts 208 and 210 for selectively receiving free weights. Each such mount may take the form of an upright member 212 secured on the connecting bar 142 and providing mounting for the horizontal bar 208, for example, onto which the free weights may be mounted.

In the depicted embodiment, each of the handhold members 130 and 132 is of sufficient length to extend horizontally toward the seated user and terminate short of a respective shoulder joint. As depicted, the padded portion 158 of each handhold member is of sufficient extent as permits the user to select a position on the handhold member which establishes the desired vertical straight-line alignment of their elbow, wrist and hand. Notably, the construction of the present apparatus provides for independent movement of the two sets of outrigger arms 68 and 70, independent selection of the height of each of the handhold members, and independent selection of the resistance to movement of each of the sets of arms through selection of placement of free weights on the apparatus.

Figure 9:
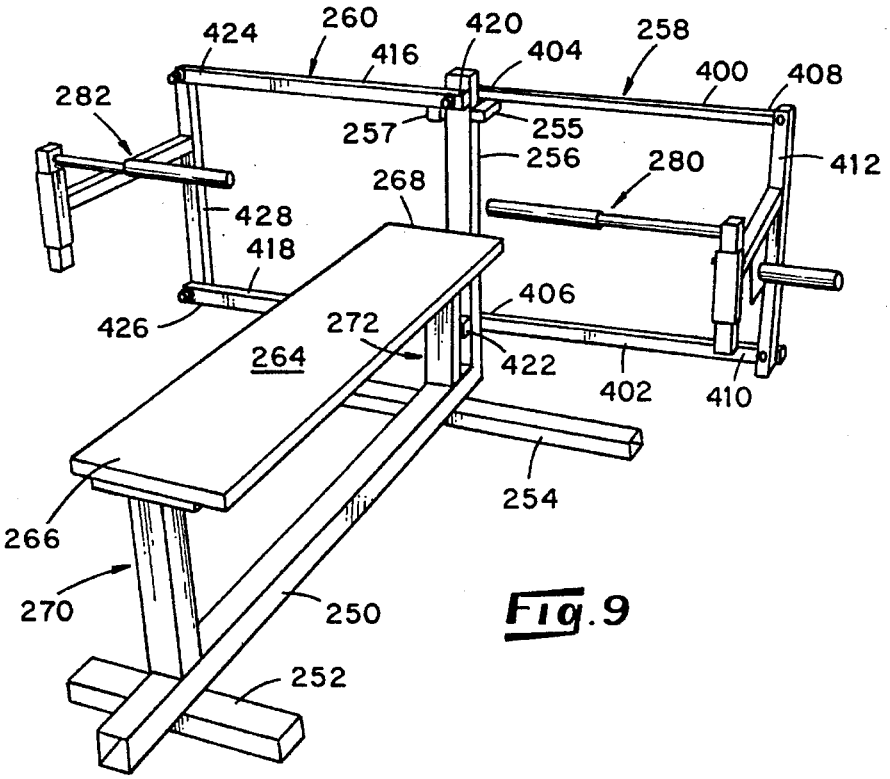
FIG. 9 is a representation, in perspective, of a further embodiment of an apparatus embodying various of the features of the present invention including means for supporting a user in a supine position and providing for flexion and extension movements of the humerus.

With particular reference to FIG. 9, a further embodiment of the apparatus of the present invention comprises a base 250 which includes lateral supports 252 and 254. An upright 256 is mounted on the base and extends upwardly to provide support for two sets of outrigger arms 258 and 260. These sets of outrigger arms are substantially identical in construction and operation to the previously described sets of outrigger arms 68 and 70. More specifically, the set of outrigger arms 258 includes first and second arms 400 and 402, having their inboard ends 404 and 406 pivotally mounted to the upstanding post 256 and their outboard ends 408 and 410 pivotally connected to one another by means of a rigid arm 412. A handhold 280 is mounted on the arm 412. The other set of outrigger arms 260 likewise includes first and second arms 416 and 418, having their inboard ends 420 and 422 pivotally mounted to the upstanding post 256 and their outboard ends 424 and 426 pivotally connected to one another by a rigid arm 428. A second handhold 282 is mounted on the arm 428. In the embodiment depicted in FIG. 9, the user 262 is positioned in the supine position (see FIGS. 10A–10C). To this end, the apparatus includes a bench 264 whose opposite ends 266 and 268 are mounted above the base 250. The mounting for the bench 264 includes telescoping members indicated generally at 270 and 272, and provides for vertical adjustment of the bench in like manner as provided for vertical adjustment of the bench 176 described hereinbefore.

Figure 10A:
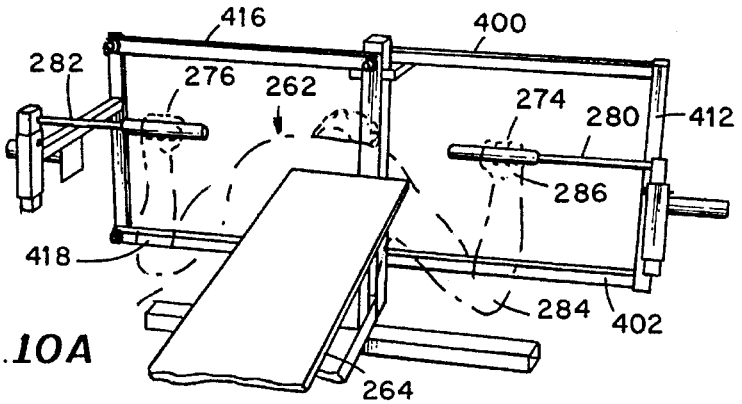
FIGS. 10A, 10B and 10C depict a user of the apparatus of FIG. 9 with FIG. 10A representing a starting position, FIG. 10B a mid-range position and FIG. 10C a maximum extended position of the apparatus.
Figure 10B:
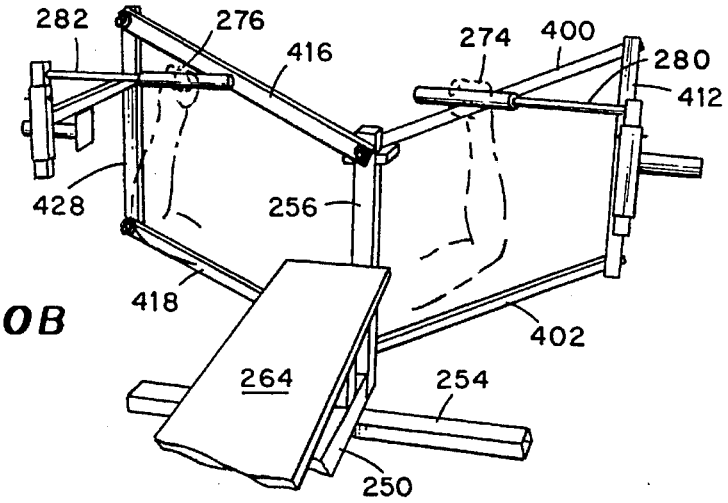
Figure 10C:
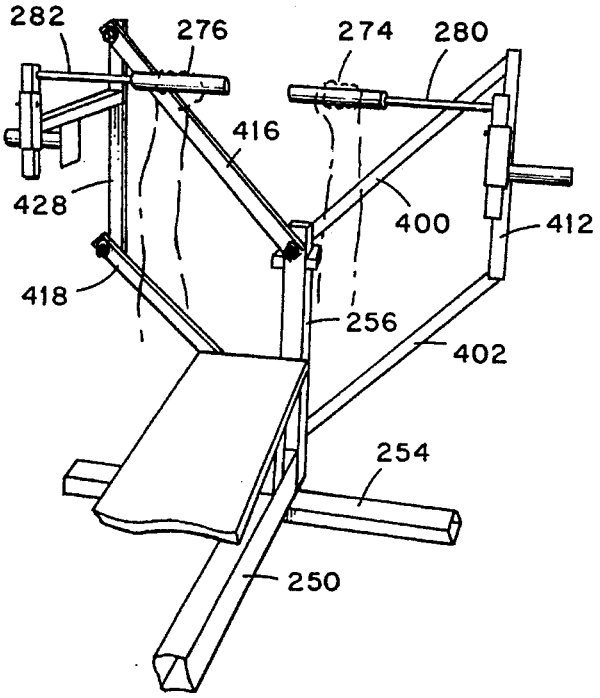

FIGS. 10A–10C depict a user 262 in the supine position upon the bench 264 of the apparatus. In FIG. 10A, the user's hands 274 and 276 are shown in position grasping the handhold members 280 and 282. The position depicted in FIG. 10A may be said to be a "starting" position, but it will be recognized that as desired, an exercise routine may be commenced at any position within the range of movement of the apparatus. For present purposes, the "starting" position is chosen to be that position of the sets of outrigger arms where they are at rest in their vertically lowermost position. It will be noted from the several Figures, that the plane (or parallel planes) of movement of the sets of outrigger arms is parallel at all times to the transverse plane occupied by the user's arms and shoulder joints over the course of an exercise cycle of the apparatus.

In accordance with one aspect of the invention as depicted in FIG. 4, the range of permissible movement of each of the sets of outrigger arms may be limited as by means of one or more stops which are positioned on the apparatus at strategic locations. In a simple form, a stop may take the form of bars 255 and 257, each of which is secured to the vertical support 256 depicted in FIG. 9.

In some exercise cycles employing the method and apparatus of the present invention, it is desirable that the cycle be commenced in the "open" position. That is, the cycle is to begin with the upper limbs fully extended and experiencing the maximum resistance to be encountered in the cycle. This starting position is considered useful in avoiding undue strain upon the user in that instead of having to exert "extra" effort to initially overcome the inertia of the apparatus as takes place when the maximum resistance is first encountered in the "closed" position (where the limbs are withdrawn to a position near the user's body, i.e. nonextended), the user starting from the "open" position only has to "release" the stored energy in the apparatus initially. Starting an exercise from an "open" position requires some type of docking mechanism which holds the apparatus in its extended position against the energy stored in the apparatus until such time as the user is ready to commence an exercise cycle.

Notably, when in the starting position depicted in FIG. 10A, the elbow 284, wrist 286 and hand 274, for example, of each of the user's arms are in vertical straight-line alignment. In this position of these elements of the user's arms, the elbow and wrist joints are "neutral", that is there is minimal lateral strain upon either of these joints and they are in their "natural" positions. Further, the humerus of the user's arm is extended from the side of the user's body at a selectable angle to the median sagittal plane thereby positioning the entire arm and the shoulder joints within a transverse plane which extends through the shoulder joints of the user. Whereas the humerus of the user depicted in FIG. 10A is disposed at a slight angle downwardly from the horizontal, this starting position is selectable by the user by adjusting the vertical positions of the handhold members. As the muscles of the upper torso become more developed, some users prefer to commence their exercise with the humerus of their arms at greater angles to the horizontal to further extend the stretch of the torso muscles. In any event, at all times, the user's arms are maintained within a transverse plane that extends through the shoulder joints. For this reason, the user initially positions his shoulder joints in substantial alignment with the handholds when mounting the apparatus.

FIG. 10B depicts the user when the apparatus has been moved by the user through about one-half of the range of motion of the apparatus. In this position, the arms of the user remain in the original transverse plane and the elbow, wrist and hand remain in their vertical straight-line alignment. Because the humerus has not moved out of the original transverse plane, the lifting forces exerted by the user upon the apparatus have not exerted any rotational strain upon the glenohumeral joint other than rotation within the transverse plane. This rotational movement of the glenohumeral joint is completely natural and not undue. It is further noted that the hands of the user have moved closer together than when in the starting position of. FIG. 10A. This movement of the hands is to be contrasted with the inability of the hands of the user to move relative to one another when exercising with a barbell or with one of the many preexisting machines which employ a rigid yoke or the like for the user to grasp with his hands. This movement of the hands toward one another as the exercise continues is critical to maintaining the straight-line alignment of the elbow, wrist and hand of the arm, and to the uniform distribution of the lifting force to the glenohumeral joints of the user.

In FIG. 10C, there is depicted the position of the user's arms when at the maximum upper limit of the range of motion of the sets of outrigger arms. In this position, the elbow, wrist and hand of each arm remains in their vertical straight-line alignment and the arms remain in the transverse plane which extends through the shoulder joints of the user. At this maximum limit of the range of motion of the sets of outrigger arms, the humerus of each of the user's arms is vertical and therefore parallel to the median sagittal plane of the user and still within the original transverse plane, thereby preventing overextension of the humerus and consequential potentially harmful rotation of the glenohumeral joints.

One cycle of exercise using the present apparatus includes repetitive movement of the sets of outrigger arms from their starting positions, to their maximum range of motion and return to the starting position. As desired, the cycle may stop short of the maximum range of motion of the outrigger arms and return to the starting position. User's with limitations in the permissible range of motion of their arms may select substantially any portion of the overall range of motion of the sets of outrigger arms. To this end, the apparatus is provided with means to limit or restrict the range of motion of the outrigger arms, such means including adjustable-height stops which are engaged by the moving outrigger arms to halt either the upward or downward limits of movement thereof. As will be noted hereinafter, the orientation of the sets of outrigger arms may be altered between vertical and horizontal, and angles therebetween, so that the references herein to "vertical", "upwardly", "horizontal" and "downwardly" and like adjectives are to be taken in context with the particular apparatus under discussion as will be recognized by one skilled in the art, and are not to be taken as limiting except where the context obviously intends such limitation.

Figure 11:
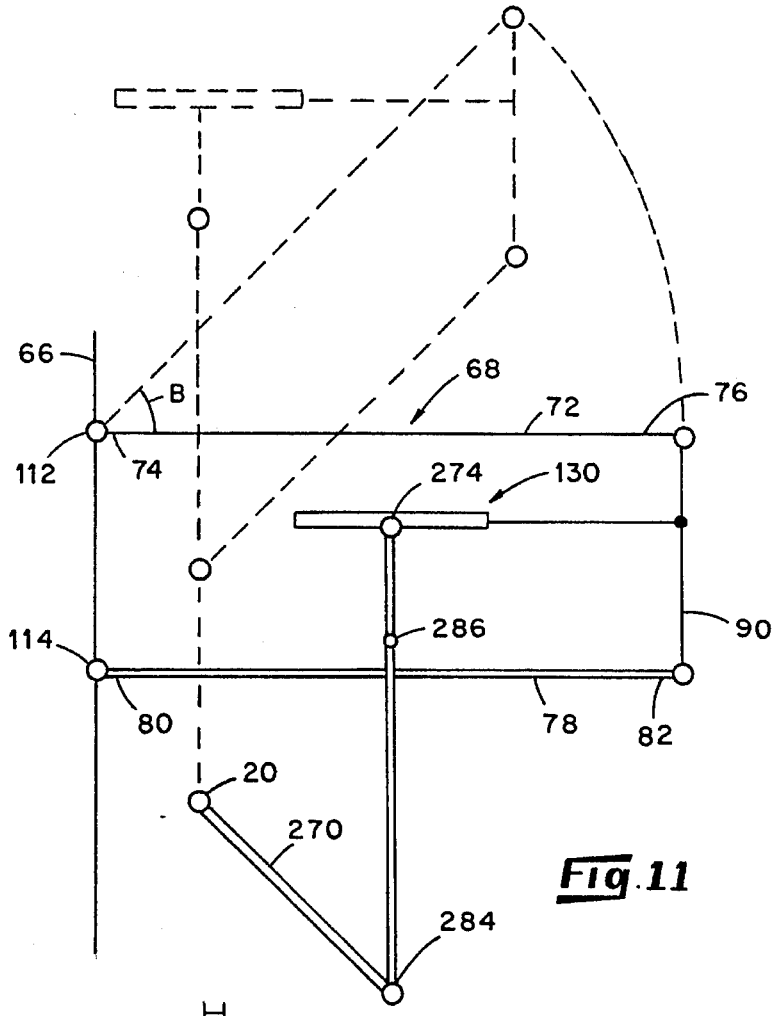
FIG. 11 is a diagrammatic representation of the range of movement of the limb of a user and an outrigger set of the type employed in the present invention as the user moves the apparatus from a closed position (solid lines) to an open position (dashed lines)

Referring now to FIG. 11, there is depicted the range of motion of a single set of outrigger arms 68 of apparatus in accordance with the present invention. As depicted, the set of outrigger arms 68 comprises the arms 72 and 78 whose ends 74 and 80 are pivotally connected at fixed locations by pivot pins 112 and 114 on the upright 66 and whose opposite ends 76 and 82 are outboard of the upright 66 and are pivotally connected to one another by the connecting bar 90. Handhold member 130 is mounted to the connecting bar 90 and extends horizontally (in FIG. 11) inwardly toward the midplane (support 66) of the apparatus. In FIG. 11, the user's humerus is indicated at 270, the elbow joint at 284, the wrist joint at 286 and the hand at 274. The assumed starting position ("first" position or minimum limit of the range of movement of the outrigger arms) of the set of outrigger arms is indicated in solid lines in FIG. 11, whereas the maximum limit of the range of movement of the set of outrigger arms ("second" position) is depicted with dashed lines. In like manner the starting and second (maximum) positions of the user's arms are depicted in solid and dashed lines, respectively. It will be recognized that the plane within which the handhold member moves is offset from and parallel to the plane within which the set of outrigger arms moves. Further, the set of outrigger arms move solely within a single plane and thereby carries the handhold member along a path within the plane of movement of the handhold member which moves the user's hand closer to the midplane of the apparatus as the outrigger set 68 pivots upwardly in the depicted embodiment. As noted hereinabove, at the starting position, the elbow, wrist and hand of the user are in straight-line alignment and fully contained within the plane of movement of the handhold member. Likewise, the shoulder joint remains within this plane. In FIG. 11, this plane is oriented vertically and therefore the straight-line alignment of the elbow, wrist and hand is vertical. As will be seen in FIGS. 12A–12E, this plane of movement of the handhold member may be selected to be horizontal or vertical or at any angle between zero and 180 degrees with respect to the coronal plane of the user, but in any event, the straight-line alignment of the user's elbow, wrist and hand is maintained and the user's arm, including the shoulder joint, remains within its plane of movement irrespective of the angle of the transverse plane with respect to the coronal plane of the user. By reason of this continued alignment of the elbow, wrist and hand, and further by reason of the user's arm being restricted to movement within the selected transverse plane (which extends through the shoulder joints of the user), the forces acting upon the glenohumeral joint are restricted to only normal movements of the glenohumeral joint. For example, at no time during an exercise cycle of the present apparatus is the humerus abnormally or unnaturally rotated so that this joint is protected against adverse strain or stress during the course of an exercise cycle.

In FIG. 11, the angle through which the set of outrigger arms moves is indicated by the angle "B". In FIG. 11, this angle is depicted as being limited to approximately 45 degrees. Through selection of stops, this angle may be adjusted to be greater or smaller than the depicted 45 degrees so that the range of movement of the set of outrigger arms may be selected to be between a relatively small angle such as about 10 degrees and a relatively large angle of about 90 degrees. Preferably, the range of movement of the outrigger arms is limited to a maximum angle of about 60 degrees. The minimum range of movement will be dictated by the capabilities of the user. For example, a person of very limited capability to exercise the upper torso may restrict the range of movement of the outrigger arms to an included angle not exceeding 10 degrees.

Figure 12A:
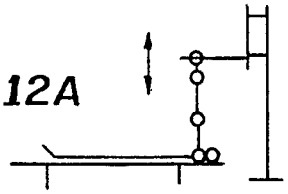
FIG. 12A, 12B, 12C, 12D and 12E are schematic representations of several embodiments of the present invention and depicting the use of the apparatus of the present invention by a user in the sitting, supine and standing positions, and further depicting different planes of motion of the user's limbs during exercise activities employing the present invention.
Figure 12B:
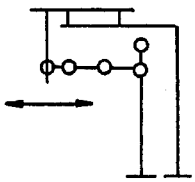
Figure 12C:
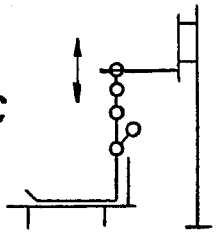
Figure 12D:
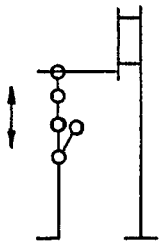
Figure 12E:
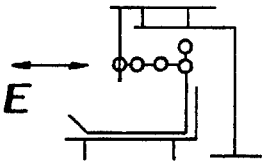
Figure 12F:
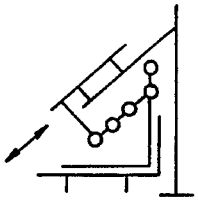

FIGS. 12A through 12E depict schematically several different positions of a user when employing the present invention in an exercise routine. In FIG. 12A, the user is supine. In this exercise position, the plane of movement of the outrigger arms is oriented vertically. Through the selection of added free weights, for example, the apparatus may be adjusted to provide resistance to a pushing force or a pulling force against the handhold members by the user. In FIG. 12B, the user is in the standing position and the plane of movement of the outrigger arms is oriented horizontally. In FIG. 12D, the user also is in the standing position, but the plane of movement of the outrigger arms is oriented vertically. This selective orientation of the plane of movement of the outrigger arms permits selection of the angular orientation of the transverse plane that extends through the shoulder joints of the user, to the desired angle of the transverse plane with respect to the coronal plane of the user. This, in turn, permits the user to exercise the upper torso muscles by moving his arms vertically up and down as depicted in FIG. 12D or horizontally as depicted in FIG. 12B. Though not depicted, it will be recognized that the angle of the transverse plane with respect to the coronal plane of the user may be selected to other than the zero degree angle depicted in FIG. 12D or the 90 degree angle depicted in FIG. 12B. For example, by lowering the set of outrigger arms depicted in FIG. 12D to a location below the waist of the user, the angle of the transverse plane may be changed by 180 degrees from the zero angle depicted in FIG. 12D and the user would be exerting lifting and lowering forces to the outrigger arms within a plane which is coincident with the coronal plane of the user. In either of the positions depicted in FIGS. 12B and 12D, the resistance to movement of the outrigger arms may be selected to permit push and/or pull resistance. In FIGS. 12C and 12E, the user is in the seated position. These seated positions provide for the same exercise routines as described for the standing positions of FIGS. 12B and 12D, the only difference being the position of the user.

Figure 13:
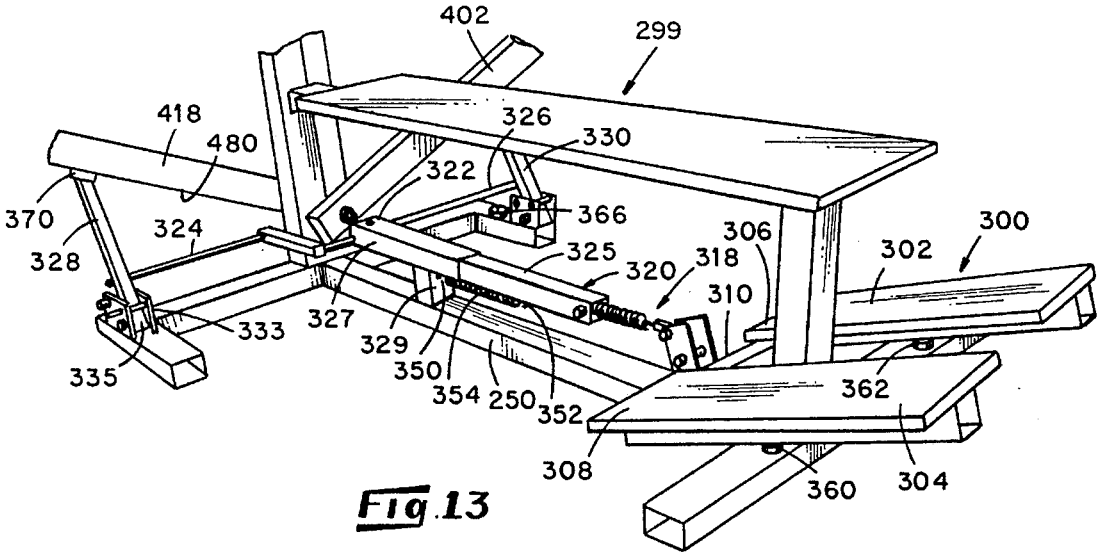
FIG. 13 is a representation of one embodiment of a docking mechanism which is particularly suitable for use with the apparatus depicted in FIG. 9.
Figure 14:
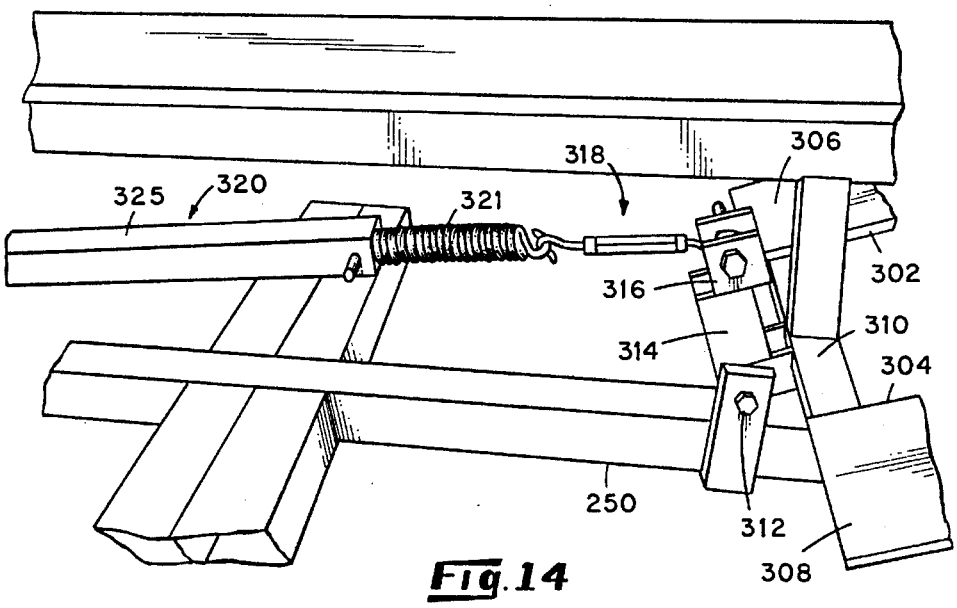
FIG. 14 is a representation of the forward portion of the docking mechanism of FIG. 13.
Figure 15:
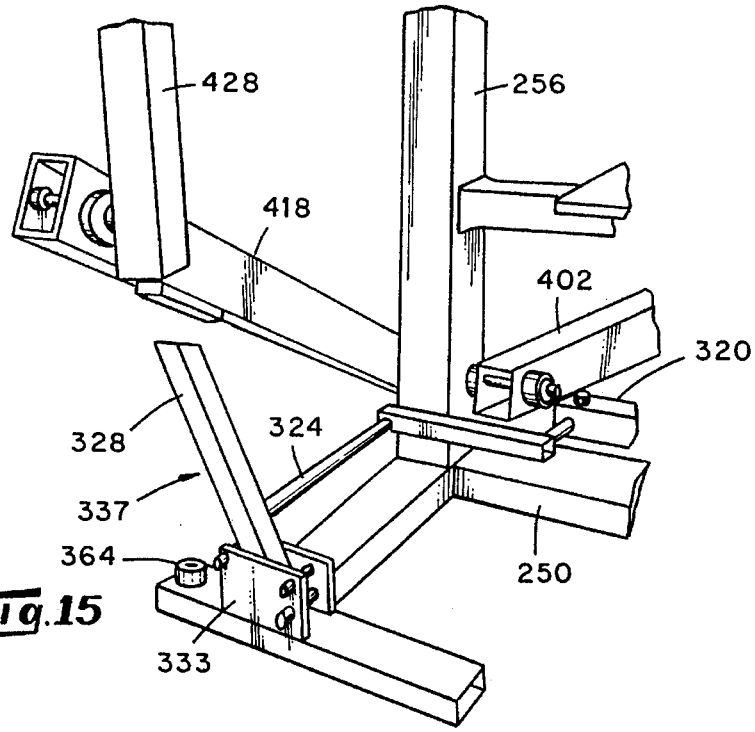
FIG. 15 is a representation of a portion of the rear, leftside, portion of the docking mechanism of FIG. 13.
Figure 16:
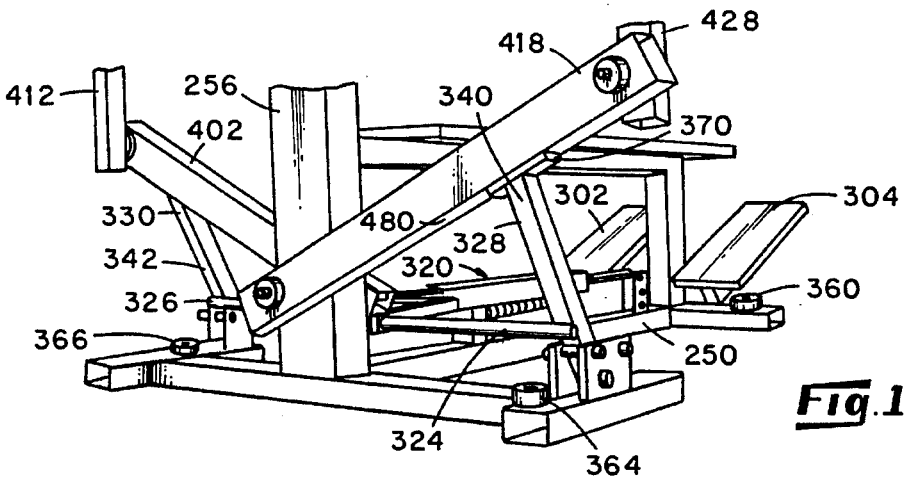
FIG. 16 is a representation of the rear end of the docking mechanism of FIG. 13.

In the present apparatus, preferably both of the user's hands are used to grasp the handholds of the two sets of outrigger arms so that a suitable docking mechanism must be operable by means other than the user's hands. One embodiment of a suitable docking mechanism for the apparatus of the present invention depicted in FIG. 9 is shown in FIG. 13.

Briefly the exercise machine 299 depicted in FIGS. 13–16 comprises a base 250 which provides support for a bench 264 on which the user reclines, first and second sets of outrigger arms 258 and 260 which are pivotally mounted on an upright 256 which is, in turn, mounted on the base 250. In this exercise machine, the docking is chosen to be effected in cooperation with the lowermost arms 402 and 418 of the two sets of outrigger arms.

In the embodiment depicted in FIGS. 13–16, the apparatus includes first and second docks 328 and 330, each of which is pivotally mounted to the base 250 of the exercise machine 299 at a location at which the dock may be moved between a position underneath the arm 418 (docking position) and a position out from under the arm 418 (non-docking position). The depicted mounting of each dock includes an upstanding bracket 333 which serves to receive and pivotally mount one end 335 of the dock. The angle of mount of the dock is chosen such that the dock is biased by gravity toward its docking position. As desired, spring means or the like (not shown) may be used to bias the dock toward its docking position. The second dock 330 is mounted in like manner as described for the first dock 328 but on the opposite side of the post 256 and at a location at which the dock may be moved between a position underneath the arm 402 (docking position) and a position out from underneath the arm 402 (non-docking position).

As depicted, the apparatus further included an activator indicated generally by the numeral 300 and includes first and second footboards 302 and 304 which are fixedly connected at their ends 306 and 308 to one another, so that they move in unison, as by means of a cross member 310. This cross member 310 is pivotally mounted to the base 250, as by means of a pivot pin 312 and includes an upstanding post 314 which, at its outboard end 316 pivotally receives a first end 318 of a resiliently extensible connector member 320. This resiliently extensible connector member 320, in the depicted and preferred embodiment, includes a coiled spring 321, but other extensible means which function or can be made to function in the nature of a coiled spring may be employed. The connector 320, in the depicted embodiment further includes an elongated rigid member 325 such as a metal tube. This rigid member 325 is slidably mounted above the base 250 as by means of a tubular mounting 327 that is supported above the base 250 by post means 329 and which slidably receives the tubular member 325 therethrough. The most rearward end 322 of the connector 320 has fixedly mounted thereon first and second arms 324 and 326 that extend laterally from the end 322 of the connector member 320 such that the first arm 324 extends to a location adjacent to, and on the rearward side 340 of the dock 328, and the second arm 326 extends laterally from the end 322 of the connector member 320 to a location adjacent to, and on the rearward side 342 of the dock 330. In these locations with respect to the docks, the arms 324 and 326 are in position to exert a forward movement (toward the foot pedals) to the docks when the connector 320 slide forwardly in its mounting 327 and effects forward movement of the arms 324 and 326, which in turn, urge the docks away from their docking positions. Rearward movement of the connector serves to move the arms 324 and 326 rearwardly to permit the docks to move by gravity to their docking positions.

In the depicted exercise machine, each of the sets of outrigger arms moves up and down independently of the other so that it is necessary to provide for docking of each set of outrigger arms. This is accomplished by providing two docks, one dock being associated with a respective set of outrigger arms. In other exercise machines, only one dock may be required.

An exercise cycle employing the depicted exercise machine depicted in FIG. 9 requires the user to grasp each of two handholds 280 and 282 with their hands—one handhold in each hand—so that the user's hands and upper limbs are not free to activate the release or engagement of the docks. To commence an exercise cycle in the open position using the depicted exercise machine requires that the two sets of outrigger arms be at or near the upper limit of their range of movement. Thus, the sets of outrigger arms must be docked at or near such upper limit. In performing an exercise cycle employing the depicted machine, the user is required to move the sets of outrigger arms from their initial upper limit position, downwardly to the extent desired by the user, thence return toward the upper limit. This cycle of movement of the sets of arms is repeated as many times as desired by the user to complete the exercise routine, whereupon the sets of arms must be raised to their upper limit and docked. This general routine is common to various exercise machines.

To effectively and safely dock the movable component or components of an exercise machine in the open position (wherein the movable component or components are biased to or near their maximum resistance level, requires that the dock not be movable away from its docking position until the user has positively acted to release the dock. Otherwise, the "loaded" movable component or components can drop or spring back in response to gravity or their stored energy and cause possible injury to the user. In accordance with the present invention, the dock is disposed relative to the movable component such that the dock opposes movement of the movable component when the dock is in its docking position. This dock is movable away from its docking position only after the taking of positive action by the user of the machine to release the dock for movement away from its docking position. In accordance with one aspect of the present invention, the dock is biased toward its docking position where the dock and movable component are in frictional engagement that tends to hold the dock in its docking position so long as the user has not moved the docked movable component out of such frictional engagement with the dock. This arrangement of the dock and the movable component ensures that the dock does not move out of its docking position until the user has complete control over the movement of the movable component. That is, in the depicted exercise machine, the user must grasp the handholds and push the sets of outrigger arms up and out of frictional engagement with the docks before the docks will move out of their docking position. However, since the user's hands and upper limbs are occupied with the lifting motion, and because the docks are biased toward their docking positions, means must be provided for the action of the user in lifting the sets of outrigger arms to result in movement of the docks away from their docking positions. This is accomplished in the present invention by initially activating means for moving the docks away from their docking position such that the bias of the docks toward their docking positions is overcome, but not overcome to the extent that the docks will move against their frictional engagement with their respective movable component. This function is supplied in part by the first resilient extensible connector member 320.

In the operation of the docking apparatus of the present invention, the user mounts the exercise machine, lying on their back on the bench 264. Thereupon, the user places their feet on the footboards, causing the footboards to be depressed and, acting through the cross member 310 and the upstanding post 314 fixed thereto, apply a force to the resilient extensible connector member 320 which tends to stretch the extensible element 321 and develop stored energy therein. This stored energy is transferred through the connector 320 to the lateral arms 324 and 326 which are in position adjacent the docks 328 and 330 for engaging the docks and moving them away from their docking positions.

This stored energy is less than that which will overcome the frictional forces existing between the docks and their respective set of outrigger arms when the outrigger arms are resting on the outboard ends of the docks, so that depression of the footboards does not effect release of the docks, but rather such depression of the footboards serves to "activate" the docking mechanism. Thereafter, upon release of the frictional engagement of the movable components (i.e. arms 402 and 418) with their respective docks, the energy stored in the docking mechanism takes over, moving the connector 320 forwardly and pivots the docks away from their docking positions. Thereafter, so long as the footboards are depressed, the docks are held away from their docking positions. However, upon the user removing his feet from the footboards, the energy imparted to the docking mechanism by the initial depression of the footboards is released, and the connector and the lateral arms 324 and 326 are free to move rearwardly such that the arms no longer engage the docks, whereupon the docks return to their docking positions under the bias provided to the docks by gravity or spring return means or the like. Preferably, this rearward movement of the connector 320 is aided by means of,a spring or like means 354, which is provided between an anchor point 350 on the base 250 and a further anchor point 352 on the connector. Importantly, the force which this spring means 354 is capable of applying to the connector is selected to be less than that force which would overcome the force applied to the extensible connector member 320 upon depression of the footboards, so that depression of the footboards remains capable of imparting sufficient stored energy to the connector to move the connector forward against the return force imparted by the spring means 354, when the sets of outrigger arms are moved out of frictional engagement with the docks. As desired, the bottom surface 480 of the arm 418 may be provided with a friction pad 370 for increasing the frictional engagement of the dock 328 with the arm 418. This pad also may serve as a type of shock absorber and noise abater. Further, the bottom surface of the arm 402 may also be provided with a like pad for the same purposes, such pad not being visible in the Figures. Various resilient bumper pads 360, 362, 364 and 366 may be provided to cushion the force of various elements of the docking mechanism and/or the exercise device as these elements achieve a limit of movement.

By reason of the fact that the present invention merely activates the possibility of the docks being moved from their docking positions, as opposed to actually moving the docks, inadvertent depression of the footboards will not release the docks. But rather, only the positive action of the user in lifting the sets of outrigger arms will result in actual movement of the docks. This provides a simple means for controlling the operation of the docking mechanism and provides a large measure of safety to the docking operation, as well as giving the user full control over the release of the docks.

Whereas specific embodiments of various of the elements of the present invention have been described, it will be recognized by one skilled in the art that various modifications may be made to the apparatus without departing from the spirit or scope of the invention. For example, the lengths of the arms of each outrigger set may be made adjustable. Further, in lieu of using free weights to counterbalance or increase resistance to movement of the outrigger sets of arms, one may employ any of several resistance devices such as the hydraulic or cable-based devices that are well known in the art.

What is claimed:

1. A method for the exercise of the upper torso of a person disposed in a supine, sitting or standing position with respect to apparatus which is movable through the use of the upper limbs of the person comprising the steps of mounting at least one handhold means for pantographic movement thereof between first and second positions along an arcuate path within a plane which is transverse to the median sagittal plane of the person and which defines an angle of between zero and 180 Degrees with respect to the coronal plane of the person, positioning the person in a supine, sitting or standing position with their median sagittal plane disposed laterally of said handhold means and substantially normal to said transverse plane, grasping said handhold means with the hand of the person, moving said handhold means between said first and second positions thereof along said arcuate path within said transverse plane whereby the wrist, elbow and hand of the person is maintained in a substantially straight line during movement of said handhold means between said first and second positions.

2. The method of claim 1 and including the steps of initially adjusting said transverse plane to an angular relationship to the coronal plane of the person to a selected value and thereupon securing this angular relationship against change thereof in the course of movement of said handhold means.

3. A method for the exercise of the upper torso of a person employing apparatus which is movable through the use of the upper limbs of a person disposed in a standing, sitting or supine position with respect to the apparatus comprising the steps of providing handhold means in a position adjacent one side of the person for grasping with the hand of the person, positioning the upper torso of the person relative to the apparatus such that the median sagittal plane of the person is in position with respect to said handhold means to permit grasping said handhold means with the hand of the user, mounting said handhold means for pantographic movement between first and second positions along a generally arcuate path which lies substantially laterally of the median sagittal plane of the person and in a transverse plane that defines an angle of between zero and 180 degrees with the coronal plane of the person, applying force through the hand which is grasping said handhold means to move said handhold means away from said first position toward said second position and away from said second position toward said first position, whereby the wrist and elbow joints and the hand of the person grasping said handhold means remain substantially within said transverse plane and the wrist and elbow joints and the hand of the person grasping said handhold means are maintained in a substantially straight-line relationship over substantially the entire range of movement of said handhold means between said first and second positions.

4. The method of claim 3 and including the step of providing a further handhold means for grasping with the other of the hands of the person, said handhold means and said further handhold means being disposed on opposite sides of the median sagittal plane of the upper torso of the person.

5. The method of claim 4 wherein said handhold means and said further handhold means disposed on opposite sides of said median sagittal plane occupy a common plane.

6. The method of claim 3 wherein the centerpoint of said arcuate path of movement of said handhold means is located substantially in the median sagittal plane of the person.

7. The method of claim 3 wherein the step of mounting said handhold means for pantographic movement includes the further step of mounting said handhold means adjacent the outboard ends of a set of outrigger arms whose inboard ends are pivotable so that movement of said handhold means is limited to arcuate movement within a plane that is substantially coincident with, or spaced apart from and substantially parallel to, said transverse plane within which said handhold means are movable.

8. The method of claim 7 wherein said plane within which said set of outrigger arms is disposed is spaced apart from said transverse plane within which said handhold means is movable.

* * * * *